US006817105B2

(12) United States Patent
LoRocco

(10) Patent No.: US 6,817,105 B2
(45) Date of Patent: Nov. 16, 2004

(54) SIGHT PIN FOR ARCHERY BOW

(75) Inventor: Paul M. LoRocco, Dallas, TX (US)

(73) Assignee: Tru-Glo, Inc., Dallas, TX (US)

( * ) Notice: Subject to any disclaimer, the term of this patent is extended or adjusted under 35 U.S.C. 154(b) by 81 days.

(21) Appl. No.: 09/993,242

(22) Filed: Nov. 5, 2001

(65) Prior Publication Data

US 2002/0073560 A1 Jun. 20, 2002

Related U.S. Application Data

(60) Provisional application No. 60/249,564, filed on Nov. 17, 2000.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | |
|---|---|---|---|---|
| 3,813,790 A | | 6/1974 | Kaltmann | 33/241 |
| 3,949,482 A | | 4/1976 | Ross | 33/241 |
| 4,070,763 A | | 1/1978 | Carts, Jr. | 33/241 |
| 4,422,719 A | | 12/1983 | Orcutt | 350/96.3 |
| 5,001,837 A | | 3/1991 | Bray | 33/265 |
| 5,121,462 A | | 6/1992 | Fabre et al. | 385/143 |
| 5,168,540 A | | 12/1992 | Winn et al. | 385/28 L |
| 5,168,631 A | | 12/1992 | Sherman | 33/265 |
| 5,201,124 A | | 4/1993 | Sherman | 33/265 |
| 5,435,068 A | | 7/1995 | Thames et al. | 33/265 |
| 5,442,861 A | | 8/1995 | Lorocco | 33/241 |
| 5,619,801 A | | 4/1997 | Slates | 33/241 |
| 5,638,604 A | | 6/1997 | Lorocco | 33/241 |
| 5,649,526 A | | 7/1997 | Ellig | 124/87 |
| 5,791,060 A | | 8/1998 | Godsey | 33/265 |
| 5,850,700 A | | 12/1998 | Capson et al. | 33/265 |
| 5,862,603 A | | 1/1999 | Ellig | 33/265 |
| 5,914,775 A | | 6/1999 | Hargrove et al. | 356/3.13 |
| 5,926,963 A | | 7/1999 | Knight | 33/241 |
| 5,956,854 A | * | 9/1999 | Lorocco | 33/241 |
| 5,975,069 A | | 11/1999 | Hamm et al. | 124/87 |
| 5,996,569 A | | 12/1999 | Wilson | 124/87 |
| 6,016,608 A | | 1/2000 | Lorocco | 33/265 |
| 2002/0042999 A1 | * | 4/2002 | Lorocco | 33/265 |

OTHER PUBLICATIONS

BearGoldenEagle Xtreme Fiber Optic Pin article; Gainsville, FL 32608 (found via the Wayback Machine Search Engine).*

PSE (Precision Shooting Equipment)—RS Glo Sight article; Tucson, AZ 85705 (found via the Wayback Machine Search Engine).*

Hoyt Integra with Tru–Glow sight pins article; Salt Lake City, UT 84116 (found via the Wayback Machine Search Engine).*

Truglo, When Brightness Counts; The Leader in Fiber Optic Sights; 1997; 6 pages.

* cited by examiner

*Primary Examiner*—Diego Gutierrez
*Assistant Examiner*—Tania C. Courson
(74) *Attorney, Agent, or Firm*—Fish & Richardson P.C.

(57) ABSTRACT

A sight pin assembly for an archery bow sight having a shaft portion and a base portion. The base portion is adapted to engage a pin holder on the bow, and has an elongate fiber-receiving aperture therein. The light-gathering optical fiber is engaged by the shaft of the sight pin and has one end closely received in the fiber-receiving aperture. The base portion has a bore which contains a light emitting member. The member is adjacent to the light-gathering fiber.

20 Claims, 2 Drawing Sheets

SIGHT PIN FOR ARCHERY BOW

This application claims priority from U.S. Provisional Application Ser. No. 60/249,564, filed Nov. 17, 2000, the disclosure of which is hereby incorporated by reference.

FIELD OF THE INVENTION

This invention relates generally to sight pins for archery bows, and more particularly to a sight pin having an optical fiber disposed therein that provides an aiming indicia.

BACKGROUND OF THE INVENTION

Sight pins are commonly used in archery bows, either singly or in multiple units, to provide aiming indicia for an archer. Typically, the pins are vertically adjustable so that the archer can control the vertical position of the aiming indicia as a function of target distance. More recently, light-gathering fluorescent fibers having spaced apart ends at which light gathered along exposed longitudinal surfaces of the fiber is emitted at the ends of the fiber to provide a bright dot, have been mounted in archery pins. The small dots are readily observable when the axis of the end portion of the fiber is aligned with the user's eye.

In previous attempts to mount light-gathering flourescent fibers in an archery pin, one end of the fiber has been mounted in a hole provided in the distal end of the pin and a second end of the fiber has been inserted through a base portion of the pin or received within a groove or ring provided on the base portion of the pin. In these arrangements, the second end of the optical fiber is also exposed. Such arrangements are not only distracting, with two aiming indicias mounted on the same pin being visible, but can actually lead to confusion and distraction, which result in decreased concentration on the correct exposed optical fiber end.

Therefore, it is desirable to have an archery pin for a bow in which only one end of an optical fiber is viewable by the archer. It is also desirable to have such a pin in which the light gathering optical fiber emits light that provides a bright aiming indicia even under low light conditions.

SUMMARY OF THE INVENTION

The present invention is drawn to a sight pin assembly having an optical fiber wherein only one end of the optical fiber is viewable by the archer, and can optionally incorporate a light emitting member to provide a bright aiming indicia under low light conditions. The sight pin assembly includes an elongate pin having a first end and a second end. An elongate light-gathering optical fiber has a first end supported at the first end of the elongate pin such that it is visible when viewing a front of the elongate pin. The second end of the light-gathering optical fiber is supported at a second end of the elongate pin and obscured from view when viewing the front of the elongate pin.

The light-gathering optical fiber is received in the second end of the elongate pin. The elongate pin has a cavity in the second end and the second end of the light-gathering optical fiber is received within the cavity. The cavity contains a light emitting member disposed adjacent the second end of the light-gathering optical fiber. The light emitting member may be tritium. At least a portion of the cavity is threaded for attachment to a pin holder of an archery bow sight. The light-gathering fiber enters the second end of the elongate pin at an obtuse angle to an axis of the elongate pin as measured between the second end of the elongate pin and the light-gathering optical fiber. Alternately, the light-gathering optical fiber enters the second end of the elongate pin at a right angle to an axis of the elongate pin. This can be concentric about an elongate cavity which is perpendicular to the axis of the elongate pin. A support fin can extend outwardly from the elongate pin which bridges a space between the light-gathering optical fiber and the elongate pin. The second end of the elongate pin may have a rectangular cross-section.

BRIEF DESCRIPTION OF THE DRAWINGS

In the accompanying drawings.

DETAILED DESCRIPTION OF THE PREFERRED EMBODIMENTS

Figure 1:
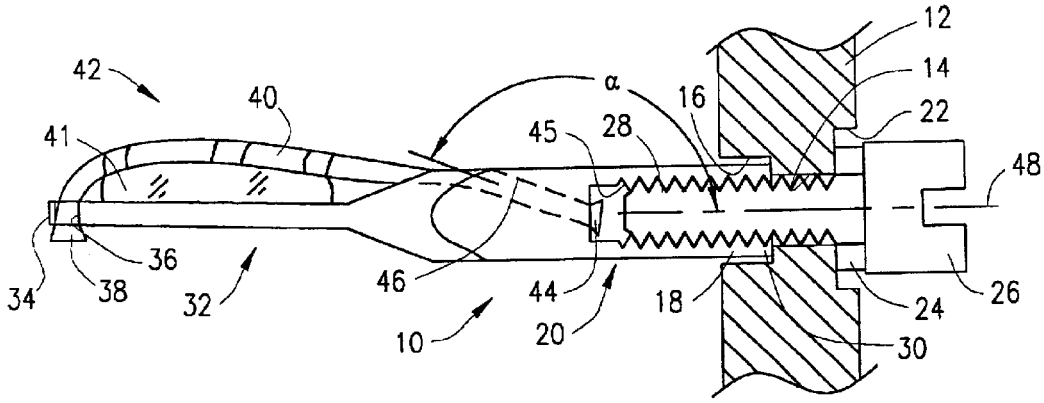
FIG. 1 is a top view of an archery pin assembly embodying the present invention, showing the archery pin assembly secured in a pin holder that is mountable on a bracket that is attachable to a bow, the pin holder being shown in section.

In the illustrated embodiment, a sight pin for an archery bow is generally indicated in the drawings by the reference numeral 10. The pin 10 shown in FIG. 1 is secured on a pin holder 12 that is attachable to an archery bow, not shown. The pin holder 12 has a vertical slot 14 that permits the pin 10 to be adjusted vertically along the slot 14. The slot 14 has an enlarged opening 16 at the pin side of a slot that it is sized to intimately receive a square or rectangular shank 18 of a base portion 20 of the pin 10, and thereby inhibit rotation of the pin 10 within the enlarged opening 16 of the slot 14. At an opposite end of the slot 14, an enlarged opening 22 is provided to receive a washer 24 or screw head therein. The pin 10 is adjustably secured to the pin holder 12 by a threaded adjusting screw 26 that engages threads provided in a threaded cavity 28 extending inwardly into the base portion 20 from an end wall 30 of the base portion 20. Tightening the adjusting screw 26 pulls the base portion 20 of the pin 10 into fixed contact with the pin holder 12, with the shank portion 18 of the base portion 20 non-rotatably seated and fixed in the slot 14. By loosening the adjusting screw 26, the position of the pin 10 can be adjusted vertically whereupon, when the pin 10 is at the desired position, the adjusting screw 26 is again tightened.

The pin 10 is conventionally formed of metal, plastic, or a combination of metal and plastic. If a combination one portion of the pin 10, e.g., the base portion 20, is formed of plastic and the remaining portion, i.e., a sighting indicia support portion 32 extending outwardly from the base portion, is formed of metal. As described above, desirably at least the base portion 20 of the pin 10 has a square or rectangular external shape to provide flat surfaces that engage the slot 14 whereby rotation of the pin 10 is prevented when the adjusting screw 26 is tightened.

A distal end 34 of the support portion 32 has an aperture 36 that is sized to intimately receive a first end 38 of an elongated light-gathering optical fiber 40. A support fin 41 bridges the space between elongated light-gathering optical fiber 40 and the pin 10 to provide support to the fiber 40. The support fin 41 can be constructed of either plastic or metal. Light-gathering optical fibers gather light along exposed circumferential surfaces of the optical fiber and focus the gathered light onto the end faces of the fiber. In the present invention, the exposed circumferential surface of the optical fiber 40 is generally indicated by the reference numeral 42. The light gathered through the exposed circumferential surface 42 is directed to the first end 38 of the optical fiber whereat the end face provides a brilliant dot, especially when the optical fiber 40 has fluorescent properties, for use by an archer as an aiming indicia. Light gathered through the exposed circumferential surface 42 is also directed to a second end 44 of the optical fiber 40, which is disposed within an end portion 45 of the threaded cavity 28 provided in the base portion 20 of the pin 10. As best shown in FIG. 1, a portion of the optical fiber 40 adjacent the second end 44 is disposed within an elongated aperture 46 extending between the end portion 45 of the threaded cavity 28 and an external surface of the pin 10. The elongated aperture 46 is preferably disposed at an obtuse angle $\alpha$ with respect to a longitudinal axis 48 of the threaded cavity 28 to avoid sharp bends in the optical fiber 40. Thus, the light directed to the second end 44 of the optical fiber is effectively blocked from view by the archer, thus avoiding any distraction or other impediment to the archer from focusing his sole attention on the bright dot at the first end 38 of the optical fiber 40.

Figure 2:
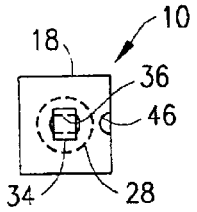
FIG. 2 is an end view of the archery pin illustrated in FIG. 3, embodying the present invention.
Figure 3:
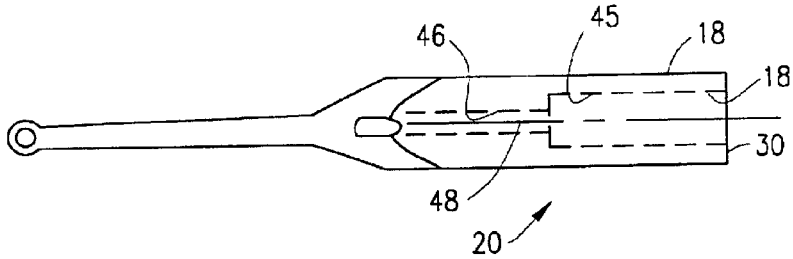
FIG. 3 is a side view of the archery pin illustrated in FIG. 1, embodying the present invention.

To more clearly illustrate the pin 10, the optical fiber 40 is not shown in FIGS. 2 and 3. However, when the present invention is considered as a pin assembly, the assembly includes not only the pin 10, but also the optical fiber 40 mounted within the pin as illustrated in FIG. 1.

Figure 4:
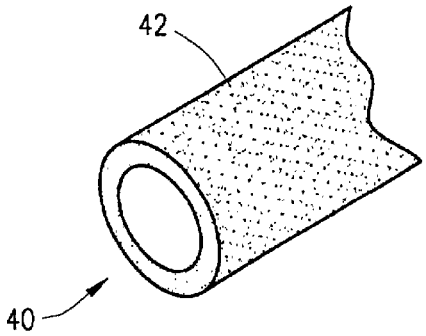
FIG. 4 is a perspective view of a colored flourescent optical fiber having a clear core.

It should also be recognized that, if desired, a light emitting source, such as a capsule containing a phosphor and a radioactive gas, e.g., tritium gas, could be disposed in the end portion 45 of the threaded cavity 28 at a position adjacent to and touching or slightly offset from the second end 44 of the optical fiber 40. If the light source is not touching the fiber 40, a distance of within approximately 0.01 inches is preferred, though greater offsets are operable and within the scope of this invention. Such an arrangement provides an additional light source for use of the pin 10 under very low light conditions when the ambient light gathered through the circumferential surface 42 of the light gathering flourescent optical fiber 40 may be diminished. Further, in situations where a light source is utilized, a clear optical fiber, colored optical fiber, or an optical fiber 40 having a clear core with an colored exposed circumferential surface 42, for example a colored flourescent cladding, (FIG. 4), can be used. When using a light source, the fiber 40 having a clear core and colored circumferential surface 42 is preferred. The clear core ensures maximum transmission of light from the light source through the optical fiber 40 in low light conditions, while the colored circumferential surface 42 produces a colored aiming indicia in moderate to bright lighting.

Figure 5:
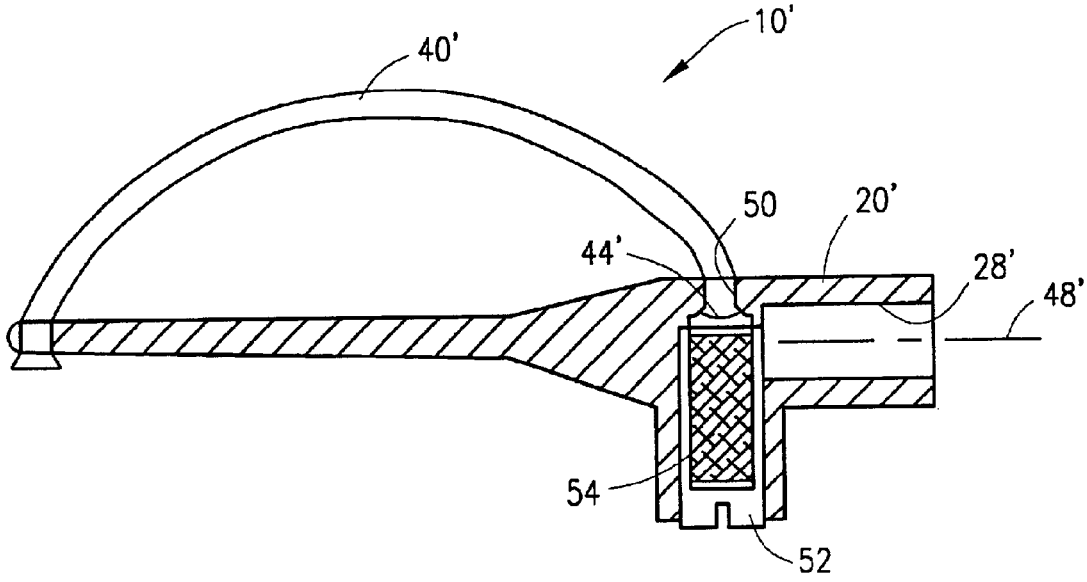
FIG. 5 is a cross-sectional view of an alternate embodiment of the archery pin assembly embodying the present invention.

In an alternate embodiment, illustrated in FIG. 5, a pin 10' has a stepped second elongated aperture 50 disposed at substantially a 90° angle with respect to the longitudinal axis 48' of threaded cavity 28'. In this arrangement, the elongated aperture 50 extends horizontally through the base portion 20' of the pin 10 with the end of the aperture 50, facing an archer, plugged with a cap 52 to prevent visual observation of the second end 44' of the optical fiber 40'. The cap 52 can thread into the base portion 20' or can be retained frictionally or with an adhesive. Also, the cap 52 can optionally contain a light source 54 which transmits light into the end 44' of the optical fiber 40'. In this arrangement, the light source 54 may comprise a vial or bulb containing a phosphor and tritium in a gaseous state. It is preferable that the light source 54 be optically coupled, for example through a lens or transparent glue, or within 0.01 inches of the end of the optical fiber 40' to ensure the optimum transmission of light into the optical fiber 40'. Distances greater than 0.01 inches have been found to be operable and are within the scope of this invention. It is also preferable that the centerline of the light source 54 be substantially aligned with the center line of the optical fiber 40' to ensure transmission of light from the light source 54 into the optical fiber 40'.

Figure 6:
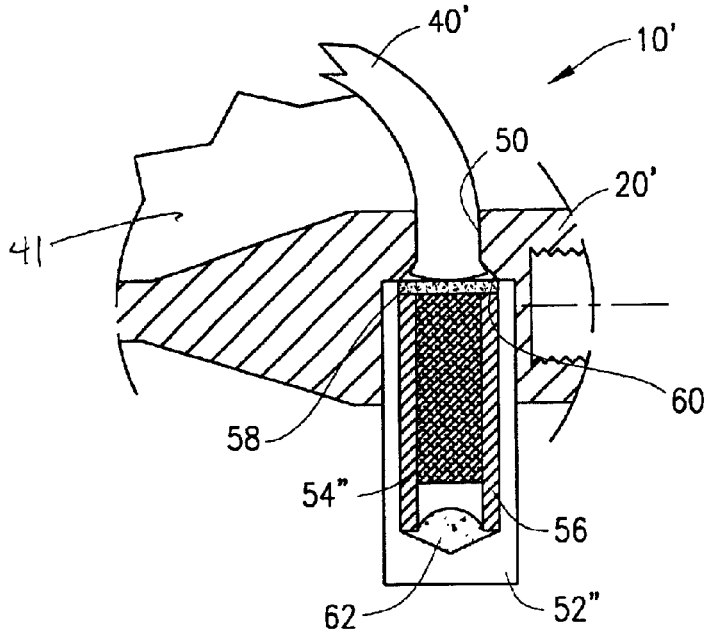
FIG. 6 is a cross-sectional view of an alternate embodiment of the archery pin assembly embodying the present invention.

FIG. 6 depicts a detail of the pin 10' utilizing an alternate configuration of light source 54". As above, light source 54" can be contained in a cap 52"; however, in this embodiment the light source 54" is surrounded by a white protective sleeve 56. The protective sleeve 56 can be, for example, a polymer material adapted to cushion the light source 54" from impact and prevent breakage. Because sleeve 56 is white, it tends to reflect light from the light source 54" inward toward optical fiber 40'. Sleeve 56 can be retained in the cap 52" with an adhesive 62.

Additionally, cap 52" can incorporate a lens 58 between the light source 54" and the second end 44 of the optical fiber 40'. Lens 58 can be configured to focus light from the light source 54" into the optical fiber 40'. In a preferred embodiment the lens 58 is a hard transparent material, for example a sapphire lens, that in additional to its optical properties, serves to shield the light source 54" from intrusion by the second end 44 of optical fiber 40'. Alternately, lens 58 can be an optical connector such as a deposit of transparent silicon, acrylic, glue or other transparent substance that transmits or focuses light from the light source 54" into the fiber 40 and protects the light source 54".

Referring again to FIG. 1, a preferred method for assembling the pin 10 with the optical fiber 40 is hereinafter described in detail. One skilled in the art will appreciate that the preferred method of assembly described herein applies to each of the embodiments described herein and depicted in FIGS. 1–6. First, the second end 44 of a length of optical fiber 40 is flared such that the diameter of the optical fiber 40 at the second end 44 is slightly greater that the diameter of the elongate aperture 46. The first end 38 of optical fiber 40 is then inserted into the elongate aperture 46 from inside the threaded cavity 28. The fiber 40 is pulled though the elongate aperture 46 until the second end 44 frictionally lodges in the aperture 46. If needed, an adhesive can be provided on the flared second end 44 to additionally secure the second end 44 in the elongate aperture 46. Also, the aperture can have a chamfered edge (best seen in FIG. 6 with respect to aperture 50 and chamfer 60). One of ordinary skill in the art will appreciate that in an embodiment utilizing a light source 54 (FIGS. 5 and 6) the flared second end 44 can act to collect and direct more light into the optical fiber 40.

With second end 44 secured in the aperture 46, the first end 38 is then inserted through the aperture 36 in the support portion 32 of the pin 10. The optical fiber 40 is then trimmed at the first end 38 to an appropriate length. The optical fiber 40 is preferably trimmed to a length that allows the fiber 40 to arc substantially smoothly from the elongate aperture 46 to the aperture 36 of the support portion 32 without kinking. If a support fin 41 is provided, the length of the optical fiber 40 should allow the fiber 40 to rest on the fin 41 substantially without slack in the fiber 40. Slack in the fiber 40 may allow the fiber 40 to shift and impact and possibly damage the light source 54.

After the optical fiber 40 is trimmed, its first end 38 is then inserted through the aperture 36. The first end 38 is then flared to be frictionally retained in the aperture 36 of the support portion 32, and such that the optical fiber 40 is substantially without slack. One of ordinary skill in the art will appreciate that flaring the first end 38 of the optical fiber 40 can increase the size of the brilliant dot seen by the user.

It is to be understood that while the invention has been described above in conjunction with preferred exemplary embodiments, the description and examples are intended to illustrate and not limit the scope of the invention. Thus, the scope of the invention should only be limited by the following claims.

What is claimed is:

1. A sight pin assembly for an archery bow comprising:

an elongate pin having a first end and a second end;

an elongate light-gathering optical fiber having a first end supported substantially at the first end of the elongate pin and visible when viewing a front of the elongate pin and having a second end with an end surface that is received in the second end of the elongate pin and obscured from view when viewing the front of the elongate pin;

wherein the elongate pin has a cavity in the second end;

wherein the second end of the light-gathering optical fiber is received within the cavity;

wherein the cavity contains a light emitting member disposed adjacent the second end of the light-gathering optical fiber; and wherein the light emitting member is spaced from the second end of the light-gathering optical fiber.

2. The sight pin assembly of claim 1 wherein the light emitting member is tritium.

3. The sight pin assembly of claim 1 wherein at least a portion of the cavity is threaded for attachment to an archery bow sight.

4. A sight pin assembly for an archery bow comprising:

an elongate pin having a first end and a second end;

an elongate light-gathering optical fiber having a first end supported substantially at the first end of the elongate pin and visible when viewing a front of the elongate pin and having a second end with an end surface that is received in the-second end of the elongate pin and obscured from view when viewing the front of the elongate pin;

wherein the elongate pin has a cavity in the second end;

wherein the second end of the light-gathering optical fiber is received within the cavity;

wherein the cavity contains a light emitting member disposed adjacent the second end of the light-gathering optical fiber; and further comprising a lens between the second end of the light-gathering optical fiber and the light emitting member to direct light into the second end of the light-gathering optical fiber.

5. A sight pin assembly for an archery bow comprising:

an elongate pin having a first end and a second end;

an elongate light-gathering optical fiber having a first end supported substantially at the first end of the elongate pin and visible when viewing a front of the elongate pin and having a second end with an end surface that is received in the-second end of the elongate pin and obscured from view when viewing the front of the elongate pin;

wherein the elongate pin has a cavity in the second end;

wherein the second end of the light-gathering optical fiber is received within the cavity;

wherein the cavity contains a light emitting member disposed adjacent the second end of the light-gathering optical fiber; and further comprising a polymer sleeve surrounding the light emitting member.

6. The sight pin assembly of claim 5 wherein the polymer sleeve is white.

7. A sight pin assembly for an archery bow comprising:

an elongate pin having a first end and a second end;

an elongate light-gathering optical fiber having a first end supported substantially at the first end of the elongate pin and visible when viewing a front of the elongate pin and having a second end with an end surface that is received in the-second end of the elongate pin and obscured from view when viewing the front of the elongate pin;

wherein the elongate pin has a cavity in the second end;

wherein the second end of the light-gathering optical fiber is received within the cavity; and wherein the light-gathering optical fiber enters the second end of the elongate pin at substantially a right angle to an axis of the elongate pin.

8. A sight pin assembly for an archery bow comprising:

an elongate pin having a first end and a second end;

an elongate light-gathering optical fiber having a first end supported substantially at the first end of the elongate pin and visible when viewing a front of the elongate pin and having a second end with an end surface that is received in the-second end of the elongate pin and obscured from view when viewing the front of the elongate pin; and wherein the light-gathering optical fiber enters the second end of the elongate pin at an obtuse angle to an axis of the elongate pin as measured between the second end of the elongate pin and the light-gathering optical fiber.

9. The sight pin assembly of claim 8 further comprising a support fin extending outwardly from the elongate pin which bridges at least a portion of the space between the light-gathering optical fiber and the elongate pin.

10. The sight pin assembly of claim 8 wherein the light-gathering optical fiber is supported substantially without slack between the first end of the optical fiber and the second end of the optical fiber.

11. The sight pin assembly of claim 8 wherein at least one end of the elongate light-gathering optical fiber is flared.

12. A sight pin assembly for mounting in a pin holder of an archery bow, comprising:

at least one sight pin having a shaft portion and a base portion, the base portion adapted to engage the pin holder and having an elongate fiber-receiving aperture therein;

a light-gathering optical fiber engaged by the shaft portion of the at least one sight pin and having one end closely received in the elongate fiber-receiving aperture, the light-gathering optical fiber further having an end surface at least partially covered by the sight pin;

wherein the base portion has an elongate cavity which has an axis that is perpendicular to the axis of the pin; and wherein the fiber-receiving aperture intersects the elongate cavity.

13. The sight pin assembly of claim 12 wherein the elongate cavity contains a light emitting member adjacent to an end of the light-gathering fiber.

14. The sight pin assembly of claim 13 wherein the light emitting member is tritium.

15. The sight pin assembly of claim 14 wherein the light emitting member is spaced from the end of the light-gathering fiber.

16. The sight pin assembly of claim 14 further comprising a polymer sleeve surrounding the light emitting member.

17. A sight pin assembly for mounting in a pin holder of an archery bow, comprising:

at least one sight pin having a shaft portion and a base portion, the base portion adapted to engage the pin holder and having an elongate fiber-receiving aperture therein;

a light-gathering optical fiber engaged by the shaft portion of the at least one sight pin and having one end closely received in the elongate fiber-receiving aperture, the light-gathering optical fiber further having an end surface at least partially covered by the sight pin; and wherein an angle between an axis of the pin and an axis of the fiber-receiving bore is obtuse when measured between the axis of the fiber-receiving aperture and the base portion.

18. The sight pin assembly of claim 17 wherein the base portion contains a light emitting member adjacent to the light-gathering optical fiber.

19. The sight pin assembly of claim 17 wherein the end of the light-gathering optical fiber received in the fiber receiving aperture is flared.

20. The sight pin assembly of claim 19 wherein the opposing end of the light-gathering fiber is flared.

* * * * *